United States Patent [19]

Smith

[11] 3,948,231

[45] Apr. 6, 1976

[54] POWER AND DECELERATION GOVERNOR FOR AUTOMOTIVE ENGINES

[76] Inventor: Norris E. Smith, 412 Fairfield, Lufkin, Tex. 75901

[22] Filed: Jan. 2, 1974

[21] Appl. No.: 430,236

[52] U.S. Cl. ..... 123/103 R; 123/108; 123/110

[51] Int. Cl.[2] ..... F12D 11/08

[58] Field of Search ..... 123/97 B, 97 R, 103 R, 123/108, 110

[56] References Cited

UNITED STATES PATENTS

| | | | |
|---|---|---|---|
| 2,516,911 | 8/1950 | Reggio | 123/103 R |
| 3,053,242 | 9/1962 | Arpaia | 123/97 B X |
| 3,431,897 | 3/1969 | Eltinge | 123/97 B X |
| 3,561,412 | 2/1971 | Yagi et al. | 123/97 B X |
| 3,603,298 | 9/1971 | Toda et al. | 123/97 B X |
| 3,841,281 | 10/1974 | Mick | 123/97 B |

*Primary Examiner*—Charles J. Myhre
*Assistant Examiner*—William C. Anderson
*Attorney, Agent, or Firm*—Arnold, White & Durkee

[57] ABSTRACT

A power and deceleration governor for automotive engines according to the present invention, may conveniently take the form of a carburetor power and deceleration system incorporating an intake manifold, vacuum controlled, butterfly type mixture flow control valve, that is disposed downstream of an idle system injection outlet of a carburetor for an automotive engine. The flow control valve is operative to terminate injection of fuel mixture into the intake manifold of the engine during phases of the engine deceleration to allow full flow of idle fuel mixture during idling of the engine and to restrict the flow of fuel mixture during acceleration above a predetermined maximum rate. The system may also incorporate means for metering exhaust gases from the exhaust manifold of the engine to the intake manifold downstream of the flow control valve of the power and deceleration and governor system. A sliding cylinder release valve, the position of which is controlled by the throttle shaft of the engine, allows a manifold vacuum energized disphragm motor to control the position of the butterfly valve responsive to the pressure condition of vacuum in the intake manifold. The deceleration governor system may also incorporate an idle override system that opens the butterfly throttle valve when the engine reaches idle speed and allows engine operation to continue through the conventional function of the carburetor idle circuit.

27 Claims, 14 Drawing Figures

FIG.6
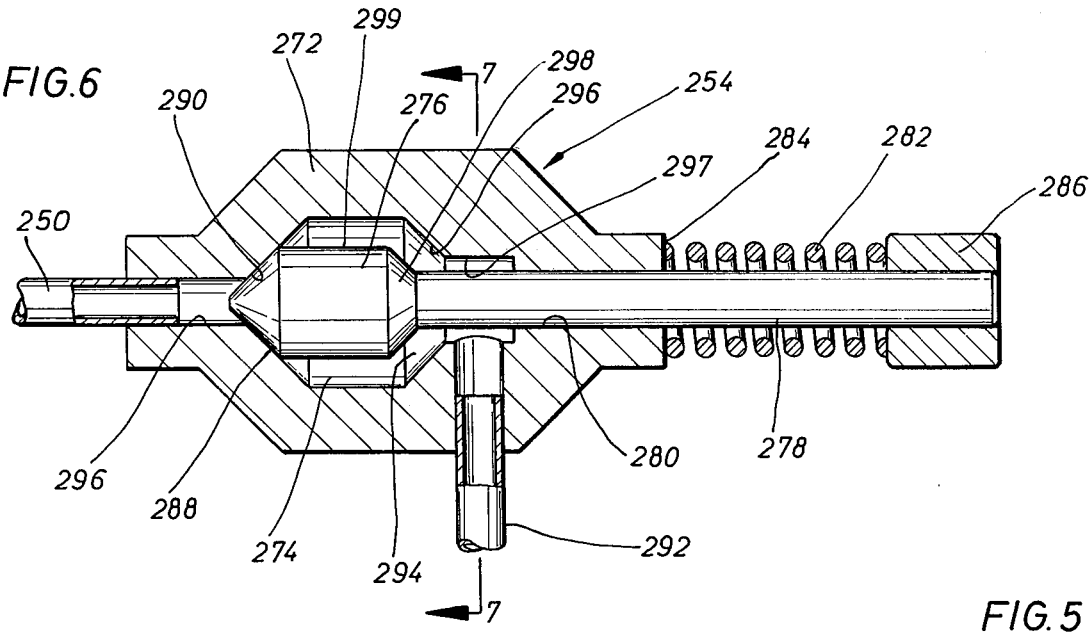
FIG. 7
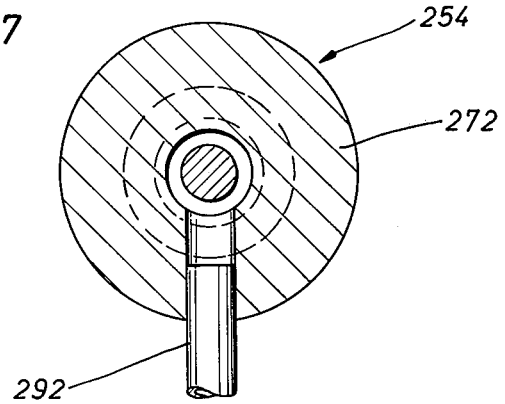
FIG. 5
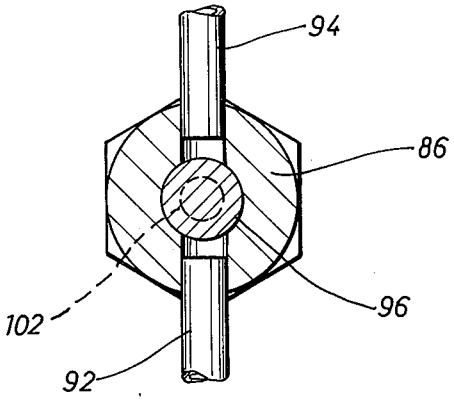
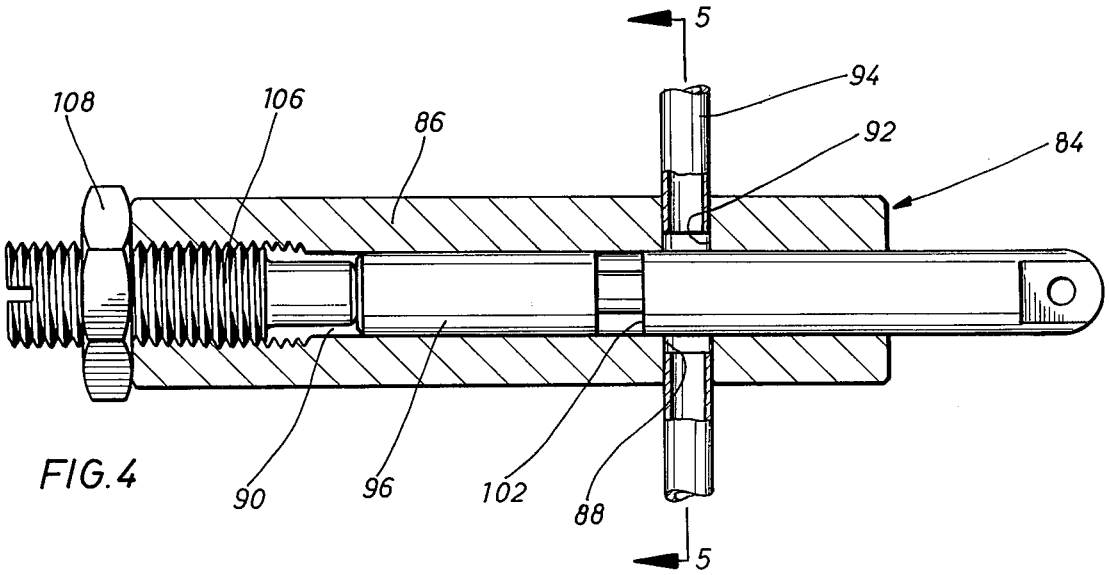
FIG.4

ENGINE OPERATING CHARACTERISTICS

| | VACUUM HG | COMPRESSION PRESSURE IN PSI | CYLINDER POWER PRESSURE IN PSI | $NO_x$ P.P.M. | HC P.P.M. | CO % MOILE | AIR-FUEL RATIO | AUTOMOTIVE OPERATION CYCLE |
|---|---|---|---|---|---|---|---|---|
| | 0 | 150 | 600 | 3800 | 145 | .5 | 11-1 | ACCELERATION |
| 7.5 | 5 | 125 | 500 | 2000 | 145 | .5 | 12-1 | |
| | 10 | 100 | 400 | 530 | 145 | .5 | 13-1 | CRUISE |
| | 15 | 75 | 300 | 240 | 195 | 2.6 | 11-1 | IDLE |
| 17.5 | 20 | 50 | MISFIRES | 0 | 2000 | 5.8 | 11-1 | DECELERATION |
| | 25 | 25 | MISFIRES | 0 | 2000 | 5.8 | 11-1 | |
| | 30 | 0 | MISFIRES | 0 | 2000 | 5.8 | 11-1 | |

POWER AND DECELERATION GOVERNOR FOR AUTOMOTIVE ENGINES

FIELD OF THE INVENTION

This invention relates generally to carburetion systems for automotive engines and more particularly relates to an acceleration and deceleration governor for the carburetion system of an automotive engine that has the function of reducing the total amount of fuel utilized for typical engine operation and also reducing the amount of exhaust emissions during most phases of engine operation.

BACKGROUND OF THE INVENTION

Fuel comsumption and exhaust emissions are major problems that concern operation of automotive vehicles of the type having carburetion systems to provide fuel mixture for engine operation. It has been determined that fuel is needlessly consumed during deceleration phases of automotive engine operation and, of the fuel that is needlessly used, a major portion of it is exhausted from the engine in an unburned or poorly combusted condition where it contributes greatly to pollution of the atmospheric environment. Unburned hydrocarbons in the emissions of an internal combustion engine is a key ingredient in the formation of photochemical smog, because hydrocarbons occur a direct result of incomplete combustion, such as occurs at its highest level during high speed deceleration of the engine of an automotive vehicle. In general, hydrocarbon emissions are high when air consumption is low and are relatively low when air consumption of engines is high.

Carbon monoxide present in the emissions of an operating internal combustion engine has been determined to exist at a relatively high level when the automotive engine is operating at idle speed and reaches its highest level during deceleration of the engine. Carbon monoxide is present at its lowest level during acceleration of the engine and at steady speeds, with small peaks occurring as a result of sudden changes in the throttle opening of the carburetor of the engine.

Another ingredient that contributes materially to air pollution is oxides of nitrogen, which exist in the emissions of internal combustion engines as nitric oxide and nitrogen dioxide. The oxides of nitrogen are toxic and also contribute to the formation of photochemical smog. The emission of oxides of nitrogen from operating internal combustion engines rises sharply during acceleration, but has little relation to vehicle and engine speed. The lowest output of oxides of nitrogen has been determined to exist at idle and during deceleration of the engine. A rich mixture, strangely enough, helps reduce the oxides of nitrogen content in exhaust gases.

It is well known that fuel consumption and exhaust emissions are determined in large measure by the operating characteristics of the internal combustion engines of automotive vehicles. When an engine is rapidly accelerated, the compression in the various cylinders of the engine increases substantially, but the presence of vacuum for drawing air and fuel mixture into the intake manifold of the carburetor reduces sharply. As cylinder power pressure increases, the existence of oxides of nitrogen in the exhaust of the automobile is at its highest level while the presence of unburned hydrocarbons and carbon monoxide is at its lowest level. During operation of automotive engines at idle, the compression pressure is quite low, while manifold vacuum increases substantially, thereby causing the cylinder power pressure of the engine to be sufficiently low that improper combustion of the fuel air mixture occurs. Under conditions of idling, the presence of hydrocarbons in the exhaust of the automobile is at its highest level and the presence of carbon monoxide also reaches its peak. It is desirable therefore, to provide an acceleration and deceleration governor system for automotive engines that effectively prevents development of engine operating conditions that cause excessive emissions and excessive fuel consumption during periods of acceleration and deceleration.

Many carburetors are provided with a device, typically referred to as a power valve, that has the effect of injecting an additional quantity of fuel through the main fuel supply system of the carburetor responsive to sensing of an abnormally low vacuum condition (high pressure condition), such as occurs when the throttle linkage of the carburetor is manipulated suddenly to cause rapid acceleration of the vehicle powered by the engine. For example, an intake manifold pressure below 7.5 inches of mercury will typically cause the power valve of the carburetor to actuate, which adds to the fuel mixture of the main fuel circuit of the carburetor the additional fuel supplied by a power valve circuit controlled by the pressure sensitive power valve. Consequently, when an automotive engine is operated at intake manifold pressures between 0 and 7.5 inches of mercury, fuel consumption will be high. The presence of hydrocarbons in the emissions of the engine will also be high during this particular period of engine operation.

During operation of the engine it is necessary to allow the engine to operate at idle speed, but is is well known that combustion is poor and the presence of hydrocarbons and carbon monoxide is at the highest level during idle operation and especially during periods when the engine is decelerating and the fuel mixture supplied to the intake manifold of the engine is at its highest level. It is of course desirable to operate the engine at idle speed as little as possible and to completely eliminate injection of fuel mixture into the engine during periods of engine deceleration.

Accordingly, it is the primary object of the present invention to provide a novel acceleration and deceleration governor system for automotive vehicle engines that terminates the flow of rich idle mixture into the intake manifold of the engine during periods of deceleration.

It is also an important object of the present invention to provide a novel acceleration and deceleration governor system for automotive engines that is responsive to manifold pressure to limit the rate of acceleration of the engine and thereby prevent excessive fuel consumption that otherwise takes place during such acceleration.

Another object of the present invention contemplates the provision of a novel acceleration and deceleration governor system for automotive engines wherein exhaust gas is metered from the exhaust manifold of the engine into the intake manifold to provide for smooth engine operation during transition between acceleration and deceleration phases of engine operation.

It is an even further object of the present invention to provide a novel acceleration and deceleration governor system for automotive engines that is controlled responsive to manifold vacuum and responsive to the position of the throttle linkage of the carburetor associated with the automotive engine.

Among the several objects of the present invention is noted the provision of a novel acceleration and deceleration governor system for automotive engines wherein the fuel mixture allowed to enter the intake manifold of the engine is effectively limited during periods of engine acceleration regardless of the position of the throttle valve of the carburetor associated with the engine, in order that fuel consumption and exhaust emissions will be auotmatically maintained within an acceptable range during acceleration.

It is also an important object of the present invention to provide a novel acceleration and deceleration governor system for automotive engines that functions responsive to intake manifold pressure conditions and includes vacuum cut-off means that renders the manifold pressure ineffective during certain desirable phases of engine operation.

Other and further objects, advantages and features of the present invention will become apparent to one skilled in the art upon consideration of the written specification, the attached claims and the annexed drawings. The form of the invention, which will not be described in detail, illustrates the general principals of the invention, but it is to be understood that this detailed description is not to be taken as limiting to the scope of the present invention.

SUMMARY OF THE INVENTION

One suitable form of the present invention may incorporate an idle cut-off valve body disposed between the carburetor and intake manifold of an internal combustion engine and having a fuel flow passage formed therein being disposed in alignment with the respective flow passages of the carburetor and manifold. Within the flow passage of the valve body may be disposed a valve butterfly that is movable from a closed position, terminating all flow of fuel mixture into the intake manifold, to a full open position allowing full flow of fuel mixture from the carburetor into the intake manifold. A suitable motor, such as a vacuum motor, may be operatively connected to a valve actuating mechanism that is capable of imparting movement to the valve butterfly between the opened and closed positions thereof against the compression of a spring or other suitable urging device. The motor controlling movement of the actuator may be responsive to pressure conditions within the intake manifold of the engine and also responsive to the position of a motor control valve that, depending upon the position of the carburetor linkage to which the valve may be connected, controls vacuum responsive energization of the valve actuator motor device.

A metering conduit may be communicated between the exhaust and intake manifolds of the engine for the purpose of metering exhaust gases into the intake manifold in order to maintain a minimal fuel mixture within the intake manifold to support immediate combustion as soon as the motor operated butterfly valve is opened during acceleration or idle operation of the engine.

The motor operated butterfly valve may be described as a power limiting and deceleration cut-off valve that is moved to the closed position thereof during increased vacuum conditions caused by deceleration and is moved to a partially open position thereof against the influence of high vacuum pressure when the engine reaches the speed of operation at idle.

BRIEF DESCRIPTION OF THE DRAWINGS

So that the manner in which the above recited features, advantages and objects of the present invention, as well as others, which will become apparent, are attained and can be understood in detail, more particular description of the invention, briefly summarized above, may be had by reference to the embodiments thereof that are illustrated in the appended drawings, which drawings form a part of this specification.

It is to be noted, however, that the appended drawings illustrate only typical embodiments of the invention and are, therefore, not to be considered limiting of its scope, for the invention may admit to other equally effective embodiments.

In the Drawings:

FIG. 1 is a sectional representation of a carburetor and a fragmentary representation of the intake and exhaust manifolds of an automotive engine, together with a partially sectional and partially schematic representation of a power and deceleration governor system constructed in accordance with the present invention.

FIG. 2 depicts a sectional view of a carburetor and fragmentary sectional views of the intake and exhaust manifolds of an automotive engine, together with a power and deceleration governor system shown partially in sectional view and partially in schematic illustration, representing a modified embodiment of the present invention.

FIG. 3 is a sectional view of a simple carburetor mechanism and fragmentary sectional views of the intake and exhaust manifolds of an automotive engine, together with a power and deceleration governor system shown partially in sectional view and partially in schematic manner, representing a further modified embodiment of the present invention.

FIG. 4 is a sectional view of a vacuum control valve mechanism that may be utilized for control of the power and deceleration governor system set forth in FIG. 1.

FIG. 5 is a sectional view taken along line 5–5 of FIG. 4.

FIG. 6 is a sectional view of a vacuum control valve mechanism that may be incorporated into the power and deceleration system set forth in FIG. 3.

FIG. 7 is a sectional view taken along line 7—7 of FIG. 6.

FIG. 8 is a sectional view of a rotary vacuum control valve mechanism that may be incorporated into the power and deceleration governor system of FIG. 2.

FIG. 9 is a sectional view of the vacuum control valve taken along line 9—9 of FIG. 8.

Figure 10:
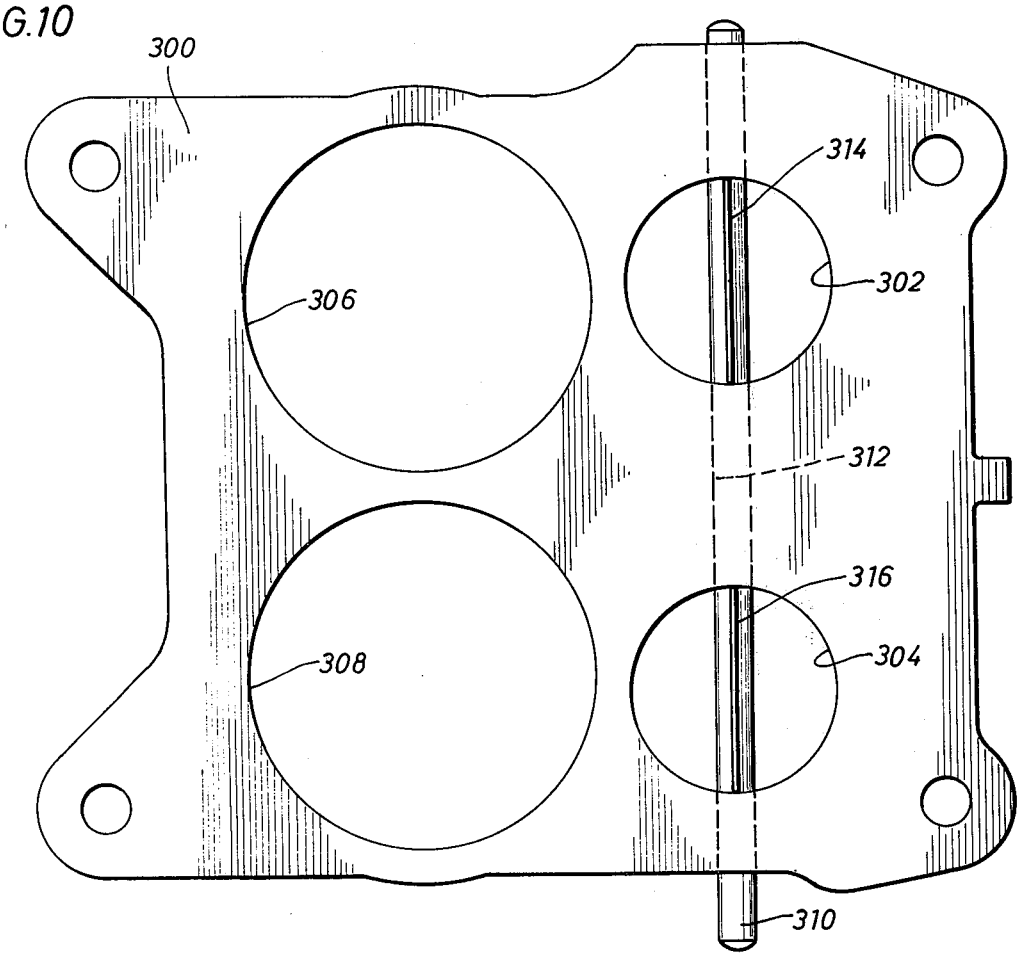

FIG. 10 is a sectional view in plan of the valve mechanism portion of a power and deceleration governor system for a 4-barrel carburetor such as is typically provided on high performance internal combustion engines for automotive vehicles and depicting disposition of the deceleration cut-off valves only in bores corresponding to the primary flow passages of the carburetor and intake manifold of the engine.

Figure 11:
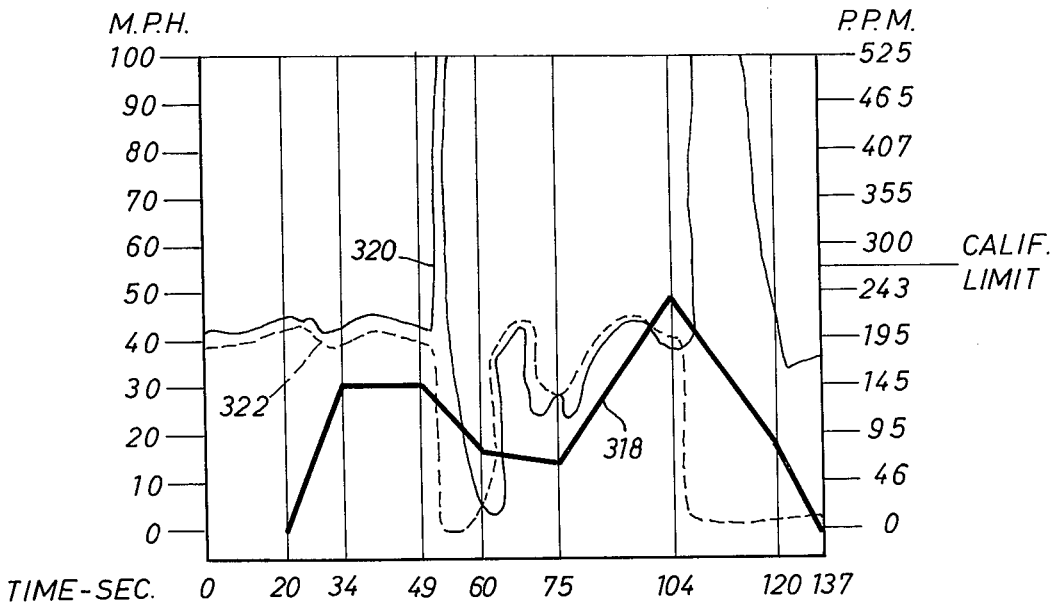

FIG. 11 is a graphical representation of a typical exhaust emission scale representing a well known test procedure for detecting the amount of total exhaust emissions of the engine of an automotive vehicle under operating conditions, to which scale has been applied the exhaust emission levels of an engine operating without a power and deceleration governor and the same engine operating under control of a power and deceleration governor constructed in accordance with the present invention.

Figure 12:
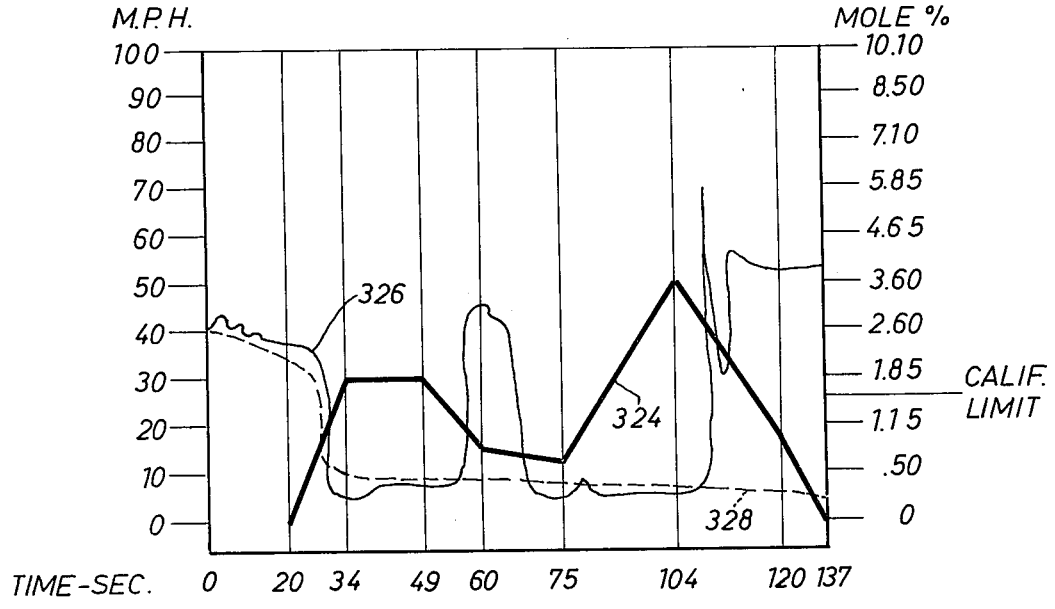

FIG. 12 is a typical graph or chart representing a test procedure for determining the quantity of carbon monoxide present in an internal combustion engine during operated conditions and depicting the carbon monoxide emissions of an automotive engine without a power and deceleration governor and the same engine provided with a power and deceleration governor constructed in accordance with the present invention.

Figures 13, 14:
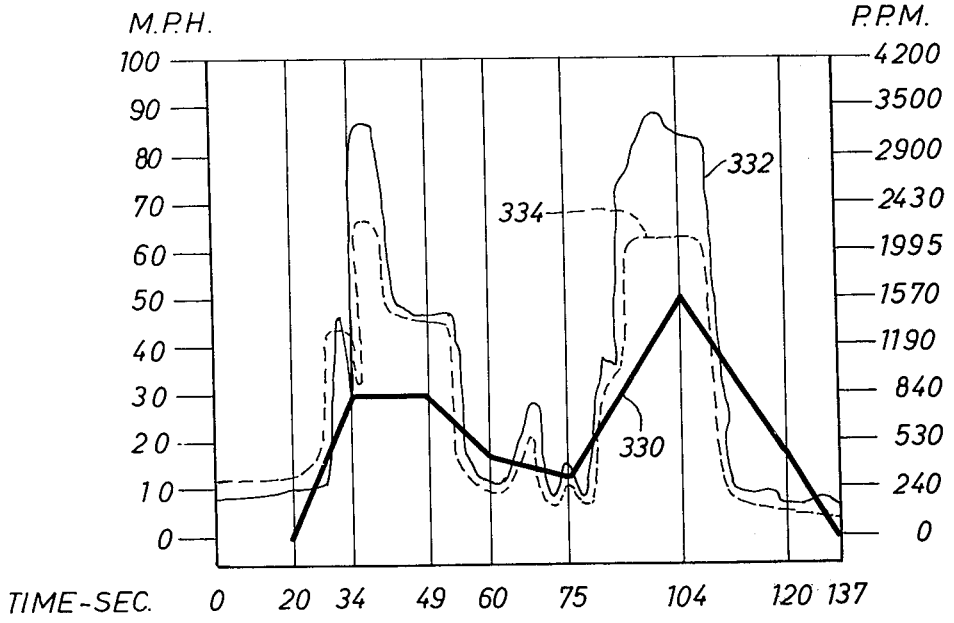

FIG. 13 is a typical automotive engine test chart or graph similar to that set forth in FIG. 12, but depicting the presence of oxides of nitrogen within the exhaust emissions of operating automotive engines, said chart likewise being provided with the oxides of nitrogen curves of a first automotive engine operating without a power and deceleration governor and a second automotive engine operating with a power and deceleration governor constructed in accordance with the present invention.

FIG. 14 is a chart representing the vacuum condition, the compression pressure, the cylinder power pressure, the oxides of nitrogen, the presence of hydrocarbon, the presence of carbon monoxide and the air fuel ratio of operating automotive engines at conditions of acceleration, cruise, idle and deceleration.

DESCRIPTION OF PREFERRED EMBODIMENTS

Figure 1:
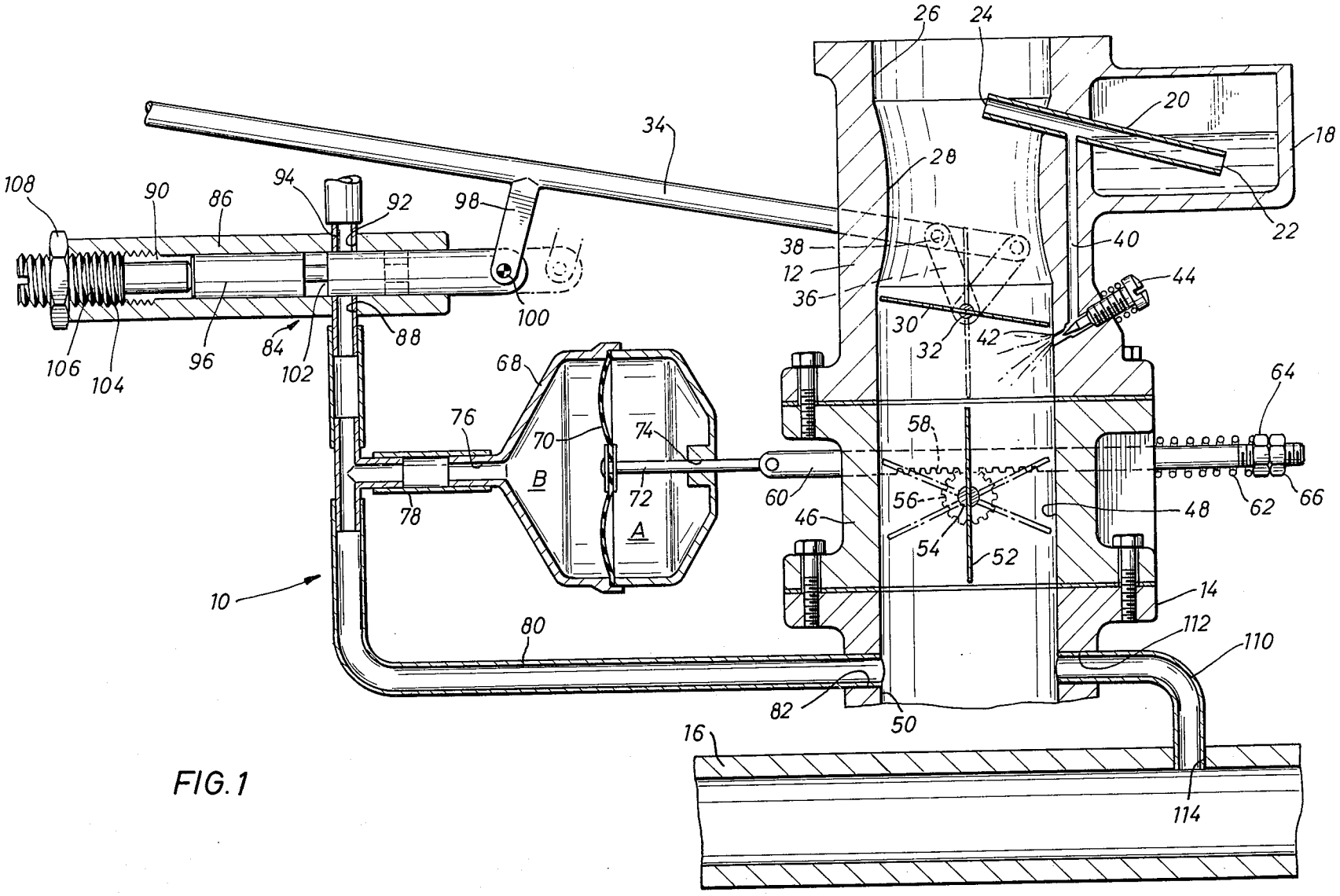

Referring now to the drawings and first to FIG. 1, there is depicted a power and deceleration governor system, generally at 10, that may be cooperatively assembled in conjunction with the carburetor 12, the intake manifold 14 and the exhaust manifold 16 of a typical internal combustion engine in order to control the power level and fuel consumption of the engine especially during acceleration and deceleration phases of the operation. The carburetor 12 is shown as a simple single barrel carburetor having a fuel reservoir 18 containing a quantity of fuel that is supplied to the reservoir from the fuel storage tank of an automotive vehicle. A conduit 20 is provided within the carburetor with its inlet 22 positioned adjacent the bottom of the reservoir 18 and submerged in the fuel within the reservoir. The outlet 24 of the fuel supply conduit or passage 20 may be disposed within the flow passage 26 of the carburetor body at the upper portion of the venturi 28. A throttle valve 30 may be disposed within the flow passage 26 of the carburetor body immediately below the venturi and may be mounted for rotation between open and closed positions by a transverse throttle shaft 32 that is journaled for rotation within the carburetor body. The throttle shaft is actuated through reciprocatory movement of a throttle rod or arm 34 and a connecting link 36, the connecting link being depicted in broken line and being connected by a pivot 38 to the operating rod 34. As the throttle operating rod 34 is moved linearly in one direction, the throttle plate or valve 30 is caused to rotate from its closed position shown in full line in FIG. 1 toward an open position depicted in broken line. Movement of the throttle plate 30 adjusts the amount of manifold vacuum being communicated to the venturi 28 and thereby adjusts or controls the volume of fuel mixture flowing through the carburetor and into the intake manifold of the engine, consequently adjusting the operating speed of the engine, depending upon the particular position of the throttle plate.

For operation of an automotive engine at idle, the carburetor will also be provided with an idle fuel system including an idle fuel passage 40 formed in the carburetor and terminating at an idle jet 42, the effective size of which may be adjusted by means of an idle mixture adjustment valve 44 which may typically take the form of a needle valve with the throttle plate 30 in the closed position thereof. As shown in full line in FIG. 1, the only fuel mixture entering the flow passage 26 of the carburetor and flowing into the intake manifold 14 of the automotive engine is that fuel flowing through the idle fuel supply passage 40 and emerging from the idle jet aperture 42. Since the het 42 remains effectively open at all times, even during periods of deceleration, fuel continuously flows through the idle fuel supply system and into the automotive engine. Because of improper conditions of fuel mixture, and because of the high vacuum that exists during deceleration, this particular fuel mixture will be improperly combusted, if it ignites at all, and this improper combustion, in addition to causing waste of fuel that is not needed during deceleration, greatly enhances the pollutants present in the emissions of the engine, thereby creating undesirable conditions of fuel waste and excessive pollutants in the exhaust emissions.

It is desirable to prevent both waste of fuel and presence of excessive amounts of pollutants in the emissions of automotive engines during deceleration phases of engine operation and, according to the present invention, one means for accomplishing the same may conveniently take the form illustrated in FIG. 1 wherein a power and deceleration governor system 10 is depicted that includes a valve body 46 that may be interposed between the carburetor 12 and the intake manifold 14 of an automotive engine. The valve body 14 may include a flow passage 48 of substantially the same dimension as the flow passage 26 of the carburetor, which flow passage may be disposed in communication with the flow passage of the carburetor and the inlet passage 50 of the intake manifold. An idle mixture cut-off valve or butterfly 52 may be disposed within the bore 48 of the valve body 46 and may be rotatably movable between a full open position, such as shown in full line in FIG. 1 and fully closed positions, illustrated in broken line. The butterfly 52 may be non-rotatably secured to a butterfly operating shaft 54 that is journaled for rotation within the valve body 46. Externally of the valve body, a pinion gear 56 may be secured to the shaft 54 and may be disposed in mating engagement with a rack-toothed portion 58 defined on a valve actuator rod 60 that is movably carried by the valve body 46. A compression spring 62, or other suitable urging means, may be carried at one extremity of the valve actuator rod 60 and may serve to urge the rod 60 in one axial direction thereof. An adjustment nut 64 may be carried by the outer threaded extremity of the rod 60 and may function to adjust the compression of the spring 62, thereby determining the force necessary for movement of the butterfly plate 52 from a closed position toward an open position thereof. A lock nut 66 may also be received by the outer threaded extremity 60 in order to lock the adjustment nut 64 in any desirable position thereof.

For the purpose of imparting movement to the rod 60 against the compression of the spring 62, a diaphragm motor 68 may be secured in fixed relation to the valve housing 46 and may incorporate a diaphragm 70 that is secured to the rod 60 by means of a connecting link 72 and separates the motor into an atmospheric pressure chamber A and a vacuum chamber B. An aperture 74 in the diaphragm motor, 68 through which the connecting link 72 extends, is of sufficient dimension that air at atmospheric pressure may enter one side of the diaphragm motor housing structure of the diaphragm motor 68 and may be communicated with a vacuum supply conduit 78 that is suitably connected to a vacuum line 80 extending from an aperture 82, defined in the intake manifold 14, to a vacuum control valve 84. The vacuum control valve may include a valve body section 86 having a vacuum inlet 88 through which the line 80 may be communicated to a valve chamber 90 defined within the valve housing 86. An outlet passage 92 may also be formed in the valve housing 86 and may receive a conduit 94 disposed in communication with the atmosphere. A piston 96 disposed with the valve chamber 90 may extend from the valve chamber. The piston 96 has a close fit within the cylindrical bore defining the valve chamber 96, but is freely slidable therein in order that the valve may be actuated upon linear movement of the throttle operating rod 34 without developing forces that would otherwise retard operation of the throttle of the carburetor.

In order to achieve controllable actuation of the piston 96, a transverse valve actuating element 98, extending from the throttle operating rod 34, may be connected by means of a pivot 100 to one extremity of the piston. As the throttle operating rod 34 is moved linearly, the valve piston 96 will be moved from the full line position, illustrated in FIG. 1, to the broken line position thereof.

An annular groove 102 may be formed in the piston element 96 and, upon movement of the throttle operating rod slightly to the right of the full line position illustrated in FIG. 1, the annular groove 102 will become aligned with the valve body aperture 88 and 92, thereby allowing atmospheric pressure to flow through the valve mechanism and into the conduits 78 and 80 and thereby causing both sides of the diaphragm 70 of the vacuum motor 68 to be subjected to substantially atmospheric pressure. Under this condition the force developed by pressures acting within chambers A and B of the vacuum motor will develop insufficient force acting upon the diaphragm 70 to overcome the force developed by the compression spring 62. The spring will, therefore, urge the valve actuating rod 60 to the right, and, through the rack and pinion mechanism, will impart rotation to the valve shaft, thereby moving the valve butterfly 52 clockwise to the closed position.

The vacuum control valve 84 may be provided with an internally threaded extremity 104 that receives an externally threaded adjustment element 106 that may be locked in any desired position relative to the valve body 86 by means of a locking element 108. The adjustment 106 merely provides a stop to limit movement of the piston 96 in one axial direction thereof.

As shown in full line in FIG. 1, the carburetion system and the power and deceleration governor system of the automotive engine are disposed at the idle position thereof with the throttle plate 30 closed to prevent flow of air through the venturi 28 and, thereby preventing flow of fuel from the aperture 24 into the intake manifold of the engine. Under this condition, however, fuel will be flowing through the idle fuel supply passage 40 and will be jetted through the aperture 42 through the open idle mixture cut-off valve 52. The manifold pressure under idle conditions will be quite low, in the order of 15 inches of mercury and this fairly high vacuum condition will be communicated into chamber B of the vacuum motor 68, thereby causing atmospheric pressure, acting in chamber A, to urge the diaphragm 70 to the left against the force of the compression spring 62, thereby maintaining the valve 52 in its open or full line position.

Assuming it is desired to accelerate from the idle position to an operating position, the throttle operating rod 34 will be moved to the right, thereby moving the throttle plate or butterfly 30 toward the broken line position thereof and also moving the piston element 96 toward the broken line position illustrated in FIG. 1. When this occurs, atmospheric pressure bypassing the throttle plate 30 will act through the open valve element 52 into the intake manifold 14, thereby substantially increasing the pressure condition within the intake manifold, in addition to charging the intake manifold with a fuel mixture caused by the flow of air past the main fuel jet aperture 24 and through the venturi 28. The increased pressure condition within the intake manifold is communicated through the line 80 and the conduit 78 into chamber B of the vacuum motor 68, thereby decreasing the pressure differential across the diaphragm 70 and, accordingly, substantially decreasing the force applied through the connecting link 72 to the valve actuating rod 60. The compression spring, sensing the reduced force imparted to the rod 60 by the diaphragm 70 will move the valve actuating rod 60 to the right toward the closed position of the valve butterfly plate 52. Of course, the valve plate 52 will not move completely to its closed position, but it will move toward the closed position to a sufficient degree to limit acceleration. The position of the valve plate 52, under this condition, will be dependent solely upon the pressure condition within the intake manifold 14, which pressure condition is conducted by conduit 80 and 78 into the chamber B of the vacuum motor 68. If the throttle plate 30 is rapidly moved to its full open position, enabling the carburetor to charge the intake manifold 14 with a large amount of fuel mixture for rapid acceleration, the valve plate 52 will prevent sufficient flow of atmospheric pressure, and thus fuel mixture, through the carburetor to achieve acceleration above a predetermined allowable rate. It is, therefore, impossible to subject the carburetor to the degree of acceleration that would result in abnormally high fuel consumption because, regardless of the position of the throttle valve, the valve plate or butterfly 52 will limit the flow of fuel mixture and, thus limit acceleration to a predetermined maximum rate.

As the engine accelerates at the maximum level allowed by the position of the valve plate or butterfly 52, the pressure within the intake manifold will increase in accordance with the gradually decreasing load on the engine and, when this occurs, the increasing pressure condition or decreasing vacuum will be communicated through the conduits 78 and 80 into the chamber B where a gradually decreasing pressure differential will exist across the diaphragm 70 due to the increasing pressure condition within the chamber B and static or atmospheric pressure condition within the chamber A.

As the engine continues to accelerate and as the load on the engine continually decreases the changing pressure conditions within the vacuum motor 68 will cause the valve 52 to be moved slowly toward its full open position as shown in broken line in FIG. 1. As the engine reaches full cruising speed, under normal operating load, the fairly low pressure condition within the intake manifold, and acting upon the vacuum motor 68, will cause the vacuum motor 68, acting through the connecting links and the valve actuating rod 60 to position the valve plate 52 at its full line or full open position, as shown in FIG. 1. It is therefore apparent, that the throttle plate 30 will control the rate of acceleration of the automotive engine only to the degree allowed by the position of the valve element 52. This will allow the engine to accelerate at a rate that will allow efficient fuel consumption. Of course, the rate of acceleration of the carburetor will be determined by the compressive value of the spring 52 and therefore, the acceleration rate allowed by the valve 52 may be changed simply by changing the position of the adjustment nut 64 and lock nut 66.

With the automotive engine operating at cruising speed and, assuming that deceleration is desired, the operator of the engine will release pressure on the throttle operating rod 34, thereby allowing the rod to move to the left, simultaneously causing movement of the throttle plate 30 and pistón element 96 of the valve 84 to the full line positions thereof. During deceleration, the pressure within the intake manifold will decrease rapidly to between 20 and 30 inches of mercury, depending upon the rate of deceleration. This decreased pressure condition will be communicated through conduits 78 and 80 into chamber B of the vacuum motor 68, thereby causing development of a substantial pressure differential across the diaphragm 70 and causing atmospheric pressure, acting within chamber A, to impart movement to the connecting links 72 and the valve actuating rod 60 toward the left, thereby causing counterclockwise rotation of the valve actuating shaft 54 which causes the valve plate 52 to move toward the closed position thereof. If the depressed condition within the intake manifold is sufficient, the compression of the spring 62 will be completely overcome and the valve element 52 will be moved fully to its closed position, where it completely terminates the flow of fuel mixture through the carburetor venturi and through the valve passage 48 and into the intake manifold. The idle jet 42, being disposed upstream of the valve 52 will be subjected to a relatively high pressure condition, substantially at atmospheric pressure and little if any fuel will be drawn through the aperture 42 and into the passage 48 of the valve body 46. The automotive engine therefore, will not be consuming fuel during periods of deceleration, thereby resulting in considerable fuel savings and also resulting in prevention of the exhaust emission pollutants that would otherwise be present during conditions of engine deceleration.

As the engine is decelerating, with the valve plate 52 in the closed position thereof, it will be desirable to provide the intake manifold 14 with a heated rather lean mixture of fuel and air. This may be conveniently accomplished by providing a metering conduit, such as illustrated at 110 in FIG. 1, that is communicated with an aperture 112 formed in the intake manifold and an aperture 114 formed in the exhaust manifold of the engine. During all phases of engine operation, the depressed condition within the flow passage 50 in the intake manifold will cause exhaust gases to be drawn through the metering tube 110 into the intake manifold. At high vacuum conditions, such as will exist during deceleration and at idle, a substantially greater volume of exhaust gases are metered through the tube 110 into the intake manifold, thereby providing a heated and combustible mixture that maintains the intake manifold charged with mixture and ready for substantially instantaneous acceleration as desired. Metering tube 110, in effect, presents the intake manifold from being devoid of mixture, where sudden opening of the throttle valve 30 might otherwise produce a dead period of short duration, typically referred to as engine hesitation, while fuel mixture is traveling from the aperture 24 through the venturi 28 and past both the throttle valve 30 and the power and deceleration control valve 52 into the intake manifold. The presence of the metering tube 110 prevents the automotive engine from coughing or hesitating when rapid acceleration is desired.

During deceleration, as the engine approaches idle speed, such as when an automobile is rapidly slowing for a traffic signal, for example, it is of course desirable that the valve plate 52 be opened to allow the idle fuel system of the carburetor to supply the intake manifold with sufficient mixture to continue operation of the engine at idle. As the engine approaches idle speed of operation, with the valve plate 52 disposed in the closed position thereof responsive to the very high vacuum condition existing during deceleration, the manifold pressure will increase from 25 to 30 inches of mercury to approximately 15 inches of mercury. This decreasing vacuum condition will, of course, be conducted to the chamber A of the vacuum motor 68 and will result in decreasing pressure differential across the diaphragm 70. At the diaphragm force developed during the idle range, approximately 15 inches of mercury, the compression spring 62 will no longer be overcome and the spring will immediately move the valve actuator rod 60 to the right, away from the vacuum motor, thereby causing the rack and pinion mechanism to rotate the valve plate 52 to the full open position and, accordingly, allowing engine operation to continue solely responsive to the fuel mixture induced into the intake manifold by the idle fuel circuit of the carburetor. The valve plate 52 thus opens automatically as the engine reaches idle speed and continues to operate at idle until acceleration is initiated.

As shown in FIG. 1, the vacuum control valve 84 is in the condition illustrated in full line when no manual pressure is applied to the throttle operating rod 32 and thorttle operating rod mechanism maintains the throttle plate 30 in its closed position and also causes the piston element 96 to be positioned with the annular groove disposed just to the left of the ports 88 and 92. As the engine is idling, high manifold pressure, in the order of 15 inches of mercury will be communicated from the intake manifold conduits 78 and 80 to chamber B of the vacuum motor 68, thereby causing the force developed by the pressure differential across the diaphragm to overcome the compression of the spring 62 and maintain the valve 52 in the position shown in full line. As the piston element 96 is moved to the right during acceleration, initial movement of the piston establishes communication between the vacuum conduit 80 and the atmospheric pressure conduit 94, thereby communicating atmospheric pressure to chamber B of the vacuum motor and thereby substantially balancing the pressure differential across the diaphragm 70. When this happens, the compression spring 62 will immediately impart clockwise movement to the valve plate 52 moving it toward one closed position thereof. As soon as the annular groove 102 of the piston 96 passes beyond the apertures 88 and 92 as it is moved to the right, atmospheric pressure will be cut off from chamber B of the vacuum motor and the vacuum motor will then be subjected solely to the pressure differential existing between manifold pressure and atmospheric pressure. This will immediately cause the valve plate 52 to assume a position between the full open position and full closed position, which position will control the rate of acceleration of the engine in the manner described above.

As the throttle operating rod 34 is allowed to move to the left by release of manual pressure acting thereupon, the annular groove 102 will become aligned with the apertures 88 and 92 for a short period of time. Assuming the piston to be moved to the left at a steady rate as the groove 102 passes the ports 88 and 92, atmospheric pressure is suddenly communicated to the vacuum motor 68, thereby causing a substantially balanced condition to exist across the diaphragm 70 allowing the compression spring 62 to suddenly move the valve actuating rod to the right, which causes the valve shaft 54 to be rotated clockwise to move the valve toward its fully closed position. After the groove 102 is moved out of registry with the apertures 88 and 92, function of the vacuum motor 68 will be responsive solely to the pressure differential between atmospheric and manifold pressures. This feature represents a vacuum cut-off condition that causes immediate closure of the valve plate 52 at the beginning of a period of deceleration irrespective of the pressure condition of the intake manifold.

Figure 2:
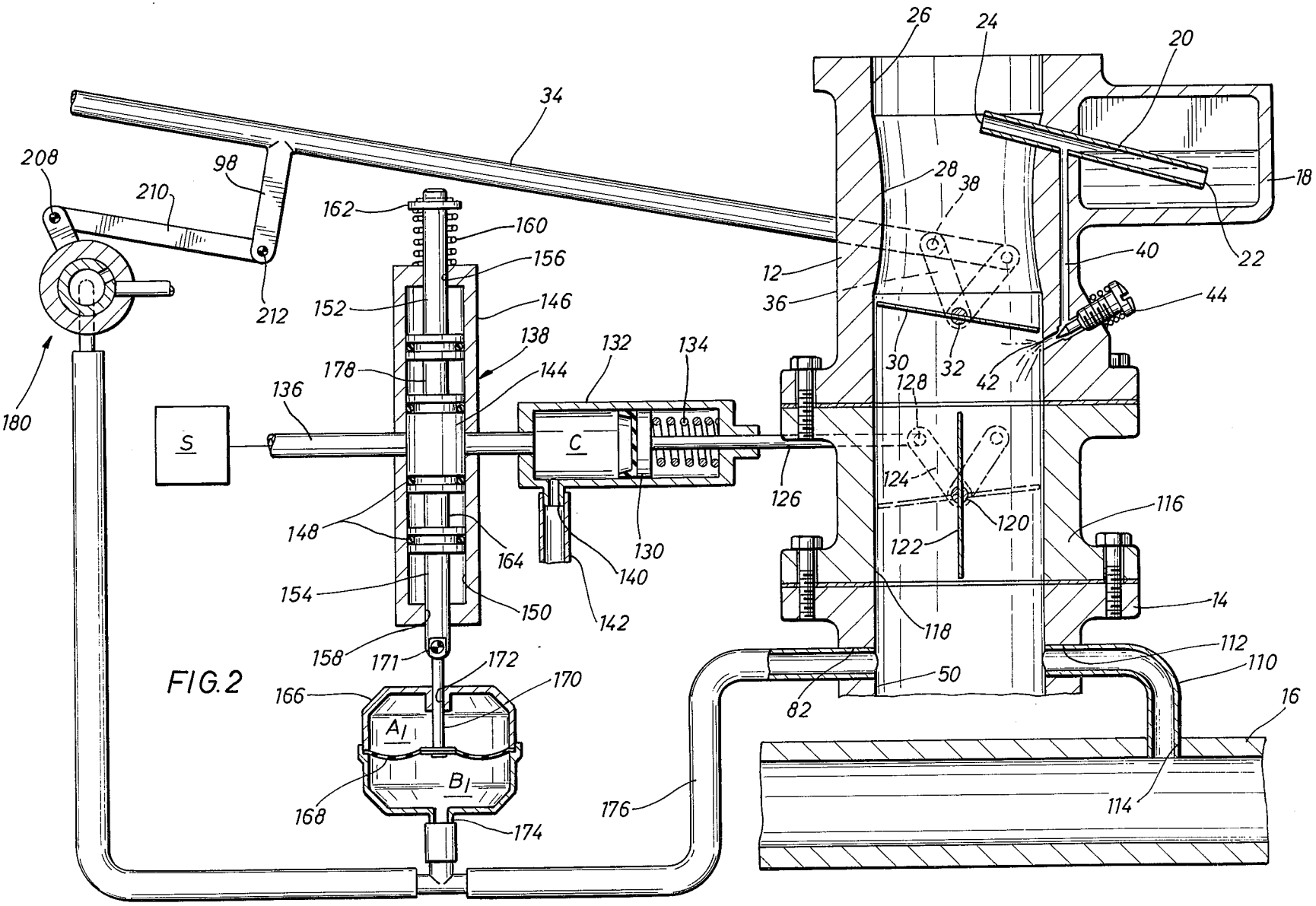

Referring now to FIG. 2, there is depicted a carburetion system including a carburetor, intake manifold and an exhaust manifold for an internal combustion automotive engine, constructed essentially identical with respect to the carburetor sytem set forth in FIG. 1 and, therefore, corresponding reference numerals will be employed for like structure in the carburetion system. The carburetion system illustrated in FIG. 2 incorporates a power and deceleration governor system representing a modified embodiment of the present invention.

The power and deceleration governor system may incorporate a valve body 116 having a flow passage or bore 118 formed therein and disposed in registry with the flow passages with the corresponding carburetor and intake manifold. A transverse shaft 120 may be journaled for rotation within the valve housing 116 and it may house a valve plate or butterfly 122 fixed thereto and rotatable between open and closed positions within the bore 118. A connecting link, shown in broken line at 124 may be disposed externally of the valve body 116 with one extremity thereof fixed to the one extremity of the transverse valve actuating shaft 120 while the opposite extremity of the connecting link 124 may be secured to a valve actuating rod 126 by means of a pivot 128.

It will be desirable to reciprocate the valve actuating rod 126 in order to impart movement to the valve plate or butterfly 122 to move it from the full open position, illustrated in full line in FIG. 2, to a closed position, illustrated in broken line. To accomplish such movement, a piston 130 may be formed or otherwise provided at one extremity of the valve operating rod 126, which piston may be disposed within a hydraulic cylinder 132 and may be actuated in one linear direction thereof by means of a compression spring 134 disposed within the cylinder. Hydraulic fluid, provided by any suitable source of supply, may be conducted through a hydraulic fluid supply conduit 136 into the chamber C of the hydraulic cylinder 132 under control of a hydraulic control valve, illustrated generally at 138. A restriction element 140 may be incorporated in a hydraulic fluid exhaust conduit 142 extending from the pressure chamber C of the hydraulic cylinder, thereby allowing hydraulic fluid to bleed away from the chamber C, to accomplish reduction pressure within the chamber upon discontinued application of hydraulic pressure from the hydraulic fluid supply conduit 136.

Control valve 138 may incorporate a piston element 144 that is movable linearly within a valve housing 146 and carries a plurality of sealing elements 148 that establish dynamic sealing engagement with the internal cylindrical surface 150 of the valve body. Piston actuating stems 152 and 154 extend from opposite extremities of the piston element 144 through respective apertures 156 and 158 of the valve housing 146. Externally of the valve housing, a compression spring 160 may be interposed between a spring retainer 162, carried at the outer extremity of the extension 152 and the valve housing 146. The compression spring 160 serves to apply sufficient force to the piston actuating stem 152 to urge the piston 144 linearly toward a position aligning a groove 164 in the piston with the hydraulic fluid supply conduit 136. When no force or insufficient force is applied to the opposite piston actuating stem or extension 154, the compression spring 160 will maintain the groove 164 of the piston element 144 in communication with the hydraulic fluid supply conduit 136 and the chamber C of the hydraulic cylinder 132 will be pressurized by hydraulic fluid flowing from the source S into the chamber C. As long as the hydraulic pressure within the chamber C is greater than the force induced by the compression spring 134 of hydraulic cylinder 132, the valve actuating rod 126 will be urged to the right, thereby positioning the valve plate 122 toward its fully closed position, illustrated in broken line.

It will be desirable to impart movement to the piston 144 of the control valve 138 in a direction opposite the force applied by the spring 160. Such may be conveniently accomplished by means of a linear vacuum motor 166 having chambers A′ and B′ defined therein by a diaphragm 168 to which may be secured a connecting link 170 that may be connected to the extension 154 of the piston 144 by means of a connecting pivot 172. Chamber A′ of the vacuum motor 166 will be disposed at atmospheric pressure because of the substantial clearance defined between the connecting link 170 and the housing structure of the vacuum motor as the connecting link extends through a housing aperture 172. Chamber B′ of the vacuum motor may be communicated by a connecting conduit 174 to a vacuum supply conduit 176 that may be received within an appropriate aperture formed in the intake manifold 14. Manifold pressure induced into the chamber B′ will, under certain conditions, develop a condition of pressure differential between chambers A′ and B′ and, under certain conditions, will impart a force to the connecting link 170 that urges the piston 144 in a direction against the force applied by the compression spring 160. When the force applied by the diaphragm to the connecting link 170 is greater than the compression of the spring 160, the valve element 144 will be moved toward the vacuum motor 166 and an annular groove 178, defined in the piston 144, will be disposed in registry with the hydraulic fluid supply conduit 136, thereby also providing the chamber C of the hydraulic cylinder 132 with a supply of pressurized hydraulic fluid for controllable operation of the valve plate 122 from its full open position toward a closed position thereof.

Figure 8:
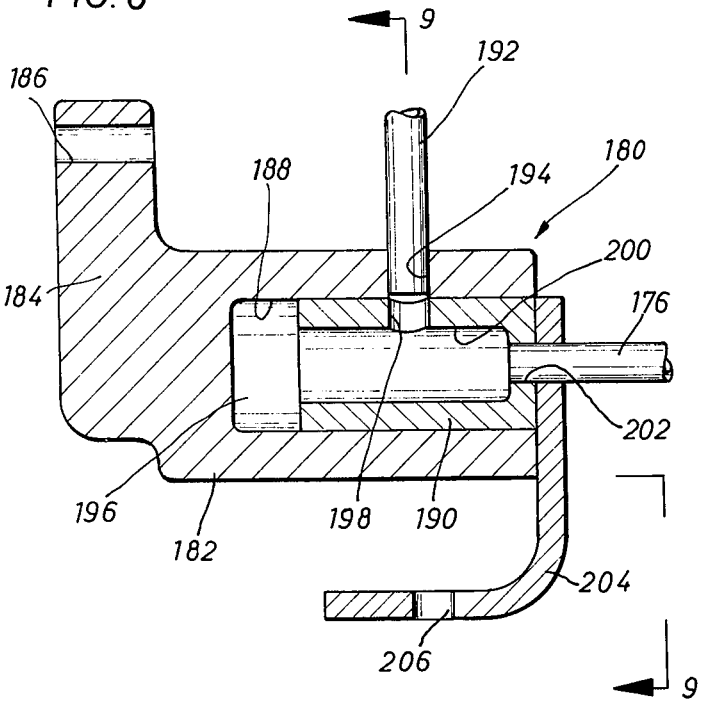
Figure 9:
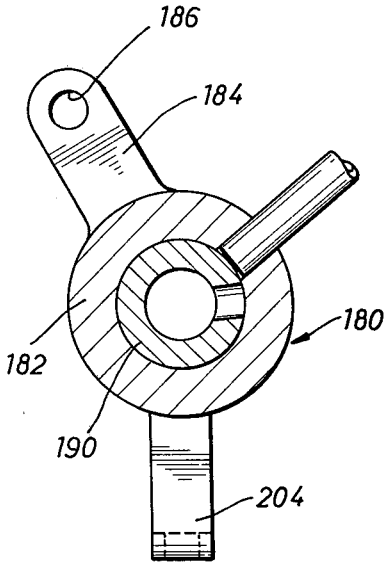

It will be desirable to render application of vacuum, applied through conduits 174 and 156 to chamber B′ of the vacuum motor 166, ineffective during certain periods of engine operation and, according to the present invention, such may be conveniently accomplished by means of a vacuum control valve, illustrated generally at 180 and shown in detail in FIGS. 8 and 9. The vacuum control valve may incorporate a valve body 182 having a connector element 184 provided with an aperture 186 that allows the body structure to be rigidly connected to any suitable immovable structure on or adjacent to the internal combustion engine. The housing 192 may be provided with an internal blind bore 188 within which may be received a rotary valve element 190 that is fitted closely within the bore 188 but is freely movable therein. The fit between the rotary valve element and the internal cylindrical walls 188 of the valve housing 182 will be such that virtually no leakage of air will occur past the valve structure even though positive seals are not incorporated between the rotary valve element and the valve body. However, if it is desired to prevent any air leakage whatever through the valve mechanism in its closed position, appropriate seals may be incorporated into the valve structure 180 without departing from the spirit or scope of the present invention.

An atmospheric pressure inlet conduit 192 may be connected to the valve housing 182 and may be disposed in communication with an aperture 194 that, in turn, communicates atmospheric pressure into a chamber 196 defined within the valve housing 182. A generally cylindrical rotor element 190 may be disposed within the chamber 196 and may be provided with a control aperture 198 that, when disposed in registry with the aperture 194, allows atmospheric pressure to flow through the conduit 192 and through the registered apertures 194 and 198 into a passage 200 defined by a blind bore formed in the rotor element. The vacuum supply conduit 176 extending from the aperture 82 of the intake manifold 14 may communicate with the passage 200 of the rotor through an appropriate connection aperture 202 within which one extremity of the conduit 176 may be connected in any suitable manner. When the ports 194 and 198 are in registry, allowing atmospheric pressure to flow into the passage 200, the atmospheric pressure will flow through the vacuum supply conduit 176 and will enter the chamber B′ of the vacuum motor through the connecting conduit 174, thereby substantially decreasing the pressure differential across the diaphragm 168 and thereby allowing the compression spring 160 of the hydraulic fluid supply valve 138 to move the valve shuttle element 144 toward a position bringing the annular groove 164 into registry with the hydraulic fluid supply passage 136. A rotor operating arm 204 may be secured in any suitable manner to the rotor element 190 and the arm may be provided with an aperture 206 that may receive a pivot 208 that operatively connects tha arm 204 to a throttle operating link 210, that is turn connected to the throttle projecting arm 98 by a pivot 212.

As illustrated in full line in FIG. 2, the throttle operating rod 34 will be in the idle position and, of course, the throttle valve 20 will be closed. The ports 194 and 198 within the vacuum control valve 180 will be out of registry and manifold vacuum, which will be in the order of 15 inches of mercury, will be communicated through conduits 174 and 176 into chamber B′ of the vacuum motor 166, thereby developing a sufficient pressure differential allowing atmospheric pressure to induce sufficient force through the connecting link 170 to the valve element 144 to partially compress the spring 160 and maintain the valve element in a position blocking flow of hydraulic fluid through the conduit 136. The compression spring 134 of the hydraulic cylinder 132, therefore, will be fully expanded, thereby maintaining the valve actuating rod 126 in a position maintaining the valve plate 122 in its full open position.

Assuming that acceleration of the engine is initiated, the throttle operating rod 34 will be moved linearly to the right, and through the connecting link 136 will cause the throttle plate to move toward its full open position, causing fuel misture to flow from the port 24, through the venturi 28, through the valve housing 116 and into the intake manifold 114. During acceleration, manifoid pressure increases toward atmospheric pressure and this increase in pressure is induced into the chamber B′ of the vacuum motor 166, thereby decreasing the pressure differential across the diaphragm 168 and allowing the compression spring 160 to move the valve shuttle 144 toward a position registering the annular groove 164 with the passageway of the hydraulic supply conduit 136. If the manifold pressure is increased substantially by virtually full opening of the throttle plate 30, the compression spring 160 will overcome the slight pressure differential across the diaphragm 168 and will cause the annular groove 164 of the valve shuttle 144 to become registered with the fluid supply passage of the conduit 136, thereby communicating pressurized hydraulic fluid into the chamber C of the hydraulic cylinder 132. Hydraulic pressure within the chamber C will act upon the piston 130, thereby urging the valve actuating rod 126 to the right against the compression of the spring 134 and thereby moving the valve plate 122 to a partially closed position to restrict the flow of mixture through the carburetor and into the intake manifold 14. The flow of mixture, thus being limited by the valve plate 122, causes the degree of engine acceleration to be limited. It will be possible, through the use of the acceleration governor aspect of the present invention to increase acceleration only to a predetermined level beyond which further opening of the throttle valve will be ineffective to produce a further increase in the rate of acceleration.

As acceleration continues at an optimum level, and, as the load on the engine decreases, the manifold pressure will gradually increase and this increase is represented in chamber B′ of the vacuum motor 166 in such manner as to decrease the pressure differential across the diaphragm 168, thereby causing the spring 160 to move the valve shuttle 144 away from the vacuum motor, causing the groove 164 to move out of registry with the hydraulic supply passage 136. This allows fluid to bleed through the restruction 140 into the discharge or return conduit 142 from the cylinder chamber C and allows the compression spring 134 to move the piston to a position causing the valve plate 122 to move toward its full open position. At cruising speed the valve plate 122 will be in the position shown in full line in FIG. 2.

As the throttle operating rod 34 is moved toward a position opening the throttle plate 30, the rotary valve element will move the valve aperture 198 into registry with the aperture 194 for a very short period of time. When the apertures are in registry, chamber B′ of the vacuum rotor 166 is substantially balanced with atmospheric pressure in chamber A′ and, therefore, the pressure differential across the diaphragm is reduced and spring 160 controls the position of the valve shuttle 144. Continued movement of the throttle operating rod 34 brings the apertures 194 and 198 of the valve element 180 out of registry and therefore causes continued operation of the vacuum motor 166 to be subjected solely to the conditions of manifold pressure.

Assuming deceleration of the automotive engine is desired, the throttle operating rod 34 will be moved to the left as shown in FIG. 2, thereby allowing the throttle plate 30 to move to its closed position. Under this condition of course, the flow of fuel mixture from the carburetor into the intake manifold of the engine is accomplished solely by means of the idle fuel supply system. Fuel mixture is not desired at this point and the fuel that flows into the intake manifold, during conditions of high vacuum that develop during deceleration, is improperly combusted and causes high emission levels in addition to causing poor fuel economy.

As the vacuum control valve is actuated by the throttle operating rod 34, through the connecting link 210, the rotor, upon moving toward the full line position illustrated in FIG. 2, causes the ports 194 and 198 to again become registered for a very short period of time. When this occurs, differential pressure across the diaphragm 168 will be substantially balanced and the shuttle 144 of the valve 138 will be induced by the compression spring 160 to assume the position illustrated in FIG. 2. Continued movement of the vacuum control valve 180 will position the rotor as shown in FIG. 2, thereby causing the vacuum motor 166 to be subjected solely to the pressure of the intake manifold, which pressure, under periods of deceleration, will be quite high. The large pressure differential across the diaphragm during conditions of deceleration will cause the shuttle 144 to be moved toward the vacuum motor 166 against the bias of the compression spring 160, thereby causing annular groove 178 in the shuttle to become registered with the hydraulic fluid supply passage 136. When this occurs, hydraulic fluid supplied through the conduit 136 into the chamber 132 will induce the piston 130 to fully compress the spring 134 and move the valve plate 122 completely to its closed position, thereby interrupting further flow of idle fuel mixture from the diel fuel supply system of the carburetor into the intake manifold of the engine.

As the engine continues to decelerate toward its idle position, the pressure within the manifold will increase from 20 to 30 inches of mercury, depending upon the degree of acceleration, toward a pressure condition at idle in the order of 15 inches of mercury. When the idle pressure is achieved in the intake manifold, the compression spring 134 in the cylinder 132 will urge the piston 130 to a position allowing the valve actuating rod 126 and connecting link 124 to move the valve plate 122 to its full open position, thereby allowing flow of idle fuel mixture from the carburetor into the intake manifold of the engine to continue engine operation at idle.

During deceleration, exhaust gases will be metered from the exhaust manifold 16 through metering conduit 110 into the intake manifold of the engine, thereby maintaining in the intake manifold a fuel mixture that supports or enhances combustion. As soon as the valve plate 122 opens, flow of idle mixture from the carburetor into the intake manifold, together with the heated and enriched gases provided in the intake manifold through the metering conduit 110, will support immediate combustion. Transition of the engine from deceleration to idle and will not cause engine hesitation that might otherwise occur if the intake manifold of the engine were maintained in a void condition during periods of deceleration.

Figure 3:
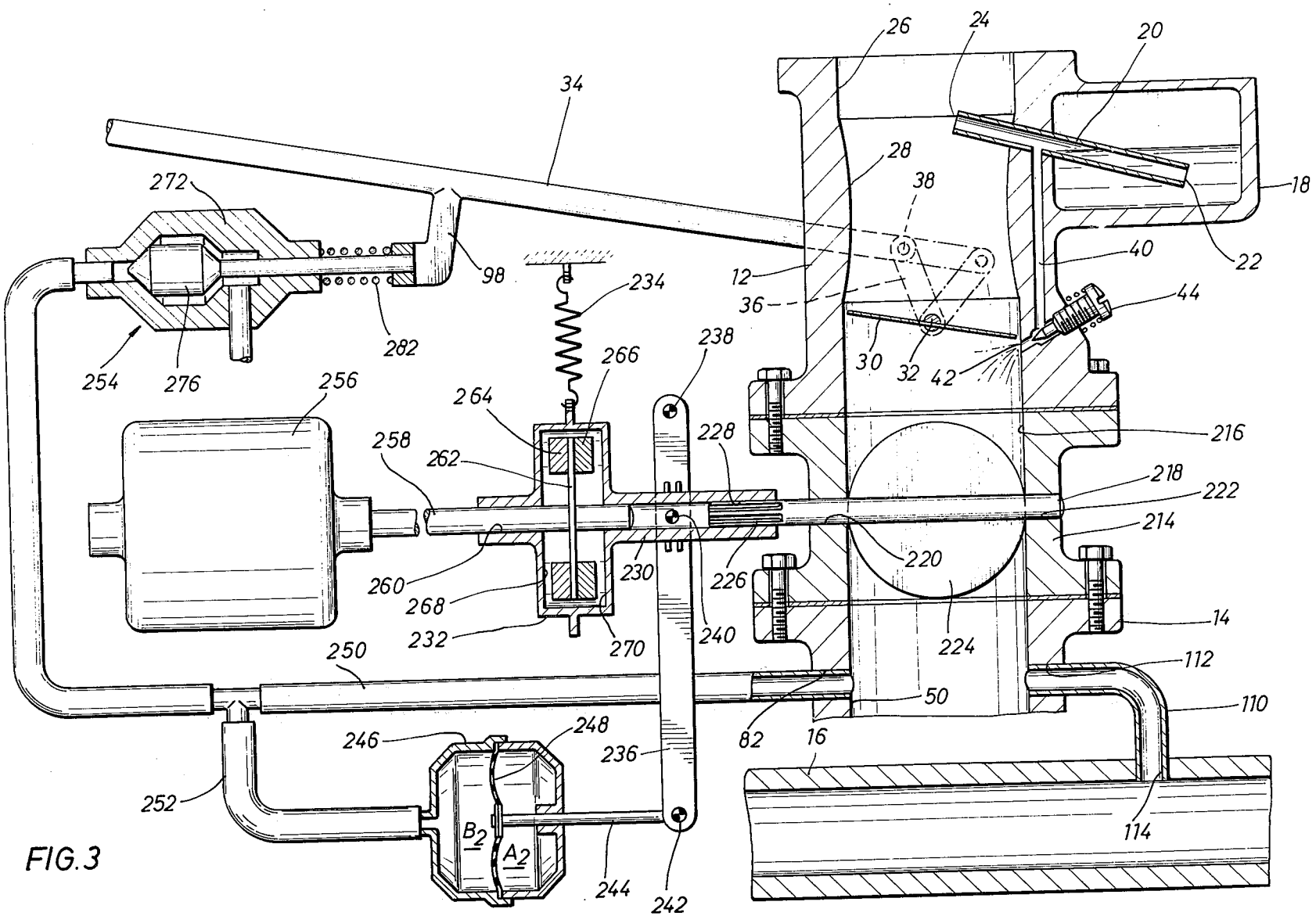

Referring now to FIG. 3 and also to FIGS. 6 and 7, another modified embodiment of the present invention is depicted that may also be incorporated with a carburetor, an intake manifold and an exhaust manifold constructed essentially identical with respect to corresponding elements illustrated in FIGS. 1 and 2, which corresponding elements will bear like reference numerals for purposes of identification.

A valve housing 214 may be secured between the carburetor 12 and the intake manifold 14 of the engine and may have a bore 216 formed therein and disposed in registry with the corresponding bores of flow passages of the carburetor and intake manifold. A transverse valve actuating shaft 218 may be journaled within journal apertures 220 and 222 in the valve body 214 and may cause rotation of a valve plate fixed thereto between open and closed positions within the bore 216. One extremity of the shaft 218 may be formed to define external splines 226 that may be received by internal splines 228 defined within a clutch shaft 230 that also incorporates a clutch housing 232. The clutch housing may be urged in one rotary direction by a tension spring 134. A clutch actuating arm 136 may be pivotally connected by a pivot 138 to any suitable structure with respect to the carburetor or the internal combustion engine and the arm may be connected by a pivot 140 to the clutch shaft 230, thereby causing the clutch shaft and the clutch housing to be reciprocated upon movement of the clutch actuating arm 136 about the pivot 138. A pivot 242 may be provided to connect one extremity of the arm 236 to the connecting link 244 of a vacuum motor 246, the connecting link being secured to a diaphragm 248 disposed within the vacuum motor and dividing the vacuum motor into chambers $A^2$ and $B^2$. A vacuum supply conduit 250 may be secured to the intake manifold of the engine and may be disposed in communiction with an aperture communicating the pressure condition of the manifold into the conduit 250. A connecting conduit 252 may provide the chamber $B^2$ of the vacuum motor 246 with intake manifold pressure or with pressure at substantially atmospheric, depending upon the condition of a vacuum control valve illustrated generally at 254 in FIG. 2 and shown in detail in FIGS. 6 and 7.

A clutch drive motor, such as a small DC electric motor, may be fixed relative to the internal combustion engine or carburetion system and may operate continuously while the engine is operating. The drive shaft 258 of the electric motor 256 may extend through a passage 260 defined in the shaft 230 and may carry a rotatable clutch plate 262 having clutch pads 264 and 266 secured thereto. As the shaft 258 is rotated, the clutch plate 262, together with the pads 264 and 266, may be freely rotated within the clutch housing 232, depending upon the particular position of the clutch housing relative to the clutch plate and pads. As the clutch operating shaft 230 is moved in either axial direction thereof upon pivotal manipulation of the arm 236 about the pivot 238, one or the other of the internal wall surfaces 268 and 270 of the clutch housing will be brought into engagement with the rotating clutch pads 264 or 266. When this occurs, the clutch housing 232 is caused by the friction forces to rotate along with the clutch plate and, through the splined connection between the clutch shaft 230 and the valve actuating shaft 218, will cause rotation of the valve actuating shaft to a particular desired position. The force supplied by the clutch to the housing is sufficient only to develop the degree of frictional force necessary to overcome the tension of the spring 234 and impart rotation of the housing and, thus rotate the clutch shaft, valve actuating shaft and valve element to a desired position. When the clutch pads 264 and 266 are out of engagement with the respective internal wall surfaces 268 and 270 of the clutch housing 232, the pull-back spring 234 will rotate the housing 232 to a position causing full closure of the valve element 224, corresponding to the similar spring induced closed position of the valve element illustrated in broken line in FIG. 1. surface Referring now to FIGS. 6 and 7, the vacuum control valve 254 may incorporate a valve body 272 having a valve chamber 274 defined therein, within which chamber may be disposed a reciprocatable valve element 276 having a valve actuating stem 278 extending freely through a stem aperture or passage 280 formed in the valve housing 272. A compression spring 282 may be interposed between a shoulder 284 defined on the valve housing and an enlargement 286 carried by one extremity of the valve actuating stem 278, thereby urging the valve element 276 toward a position moving a tapered sealing surfacd 288 of the valve element out of engagement with a correspondingly tapered seat surface 290. When this occurs flow of atmospheric pressure is allowed through an atmospheric pressure supply conduit 292 into a valve chamber 294 defined within the valve body and through an outlet passage 296 to which the vacuum supply conduit 250 may be appropriately connected in any suitable manner.

Within the valve housing 272 may be defined a generally conical seat surface 296 that may be engaged by a conical external surface 298 defined on the valve element 276. As the valve element moves completely to the right as illustrated in FIG. 6 the tapered surface 298 of the valve element will move into sealed engagement with the tapered seat surface 296 of the valve body, thereby terminating flow of atmospheric pressure into the valve chamber. Thus, with the valve element 276 in an intermediate position, atmospheric pressure will be allowed to flow through the inlet 292 to the valve chamber 294 and the outlet passageway 296 to the vacuum supply conduit 250. With the valve element 276 disposed at either of its extreme right or left positions as shown in FIG. 6, flow of atmospheric pressure into the vacuum supply conduit 250 will be effectively blocked.

The projecting arm 98, extending from the throttle operating rod 34 at conditions of carburetor idle or deceleration, will be disposed in abutment with the extremity of the valve actuating stem 278, thereby causing compression of the spring 282 and causing movement of the movable valve element 276 to the closed position illustrated in FIG. 3.

At idle operation of the internal combustion engine, the throttle operating rod 34 will maintain the projection 98 in abutment with the actuating stem 278 of the valve 276, thereby urging the tapered sealing surface 288 into engagement with the valve seat 290, thereby blocking the flow of atmospheric pressure from the conduit 292 into the outlet passage 296 and therefore the vacuum valve 246 will be maintained at manifold pressure, which will be in the order of 15 inches of mercury. The pressure differential existing across the diaphragm 248, under idle condition, will be sufficient to maintain the clutch housing 232 in the intermediate position thereof, as illustrated in FIG. 3, thereby preventing the valve element 224 from being subjected to any closing force. The valve element will be fully opened at idle, thereby allowing idle mixture to flow from the idle jet 42 into the intake manifold 14 of the engine.

Assuming that acceleration is desired, the throttle operating rod 34 will be moved linearly to the right as illustrated in FIG. 3, thereby moving the projection 98 to the right and allowing the compression spring 282 to move the valve element 276 out of sealing engagement with the seat 290. Under this condition, atmospheric pressure will be allowed to flow through the inlet conduit 292 and through the outlet passage 296 to the vacuum supply conduit 250, thereby causing the chamber $B^2$ of the vacuum motor 246 to be subjected to substantially atmospheric pressure and thereby materially decreasing the pressure differential across the diaphragm 248. When this occurs, the tension spring 234 will induce rotation of the clutch housing 232 to a position causing the valve shaft 218 and the valve plate 224 to be moved toward a closed position of the valve plate. As the valve element 276 is moved under the influence of the spring 282 into the cylindrical portion 296 of the valve housing, after a slight linear movement of the valve element, flow of atmospheric pressure through conduit 292 and into the valve chamber 274 will be effectively terminated, thereby allowing the vacuum supply passage 250 to be subjected solely to the pressure of the intake manifold which, according to the particular rate of acceleration, may vary from zero to approximately 12 or 13 inches of mercury. The pressure differential existing across the disphragm 248, through the connecting link 244 and the clutch arm 236, will induce movement of the lower portion of the arm toward the vacuum motor 246, thereby urging the internal surface 270 of the housing 232 into engagement with the clutch pad 266. When this occurs, the friction force developed between the rotating clutch elements and the internal surface 270 of the housing 232 will cause rotation of the housing 232 against the force developed by the tension spring 234. Under this condition, the valve 224 will be in its partially open position, restricting the flow of mixture through the carburetor and into the intake manifold, thereby restricting the rate of acceleration to a predetermined maximum level that is determined by the tension of the spring 234 and the pressure within the manifold 14. As the speed of the engine increases and the engine load decreases, the intake manifold pressure will increase gradually, thereby gradually decreasing the pressure differential across the diaphragm 248. Likewise, the force induced to the clutch arm 236 will be decreasing and the tension spring 230 will tend to rotate the clutch housing 232 to a position causing the valve element 224 to move toward its full open position. As the engine reaches cruising speed, the valve element 224 will have reached its full open position, thereby allowing the engine of the vehicle to be operated at any desired speed as long as manifold pressure does not decrease below the cruising pressure range. This feature effectively conserves fuel during acceleration and also prevents high emission rates that are otherwise present during rapid acceleration of automotive engines.

Assuming that deceleration is desired, the throttle operating rod 34 will be allowed to move to the left, as illustrated in FIG. 3, thereby causing the projection 98 to engage the extremity of the valve actuating stem 278 and moving the valve portion 276 to the left toward seating engagement with seat 290. During such movement, a position is reached where the cylindrical surface 298 of the valve element is clear of the cylindrical surface 296 of the valve body and flow of atmospheric pressure through the valve mechanism and into the vacuum supply conduit 250 is allowed. When this momentary condition occurs, the force developed by the vacuum motor 246 will immediately dissipate and the clutch housing 232 will be immediately rotated to a position by the tension spring 234 that causes the opposite friction surface 268 of the housing 232 to engage the clutch pad 264 and thereby develop sufficient frictional force to impart rotation to the clutch shaft 230, the valve shaft 218 and the valve plate 224 to a position closing the valve. The valve element 276 of the vacuum control valve 254 then continues movement under influence of the projection 98 until it engages the tapered seat 290 and terminates further flow of atmospheric pressure into the vacuum supply conduit 250. Under this condition, further actuation of the valve plate 24 will be influenced solely by manifold pressure.

During deceleration, manifold pressure will be quite high, in the order of 20 to 30 inches of mercury, depending upon the rate of deceleration. The pressure differential across the diaphragm 248 will, therefore, be great causing substantial force to be induced to the clutch arm 236 which maintains the friction surface 270 of the housing 232 in engagement with the clutch pad 266. As the engine decelerates to a predetermined minimum speed, determined by the position of idle operation, the manifold pressure will have increased to approximately 15 inches of mercury, the manifold pressure at idle, and at this particular manifold pressure, the pressure differential across the diaphragm 248 will be insufficient to overcome the spring 234. When this occurs, the clutch housing 232 will be rotated by the spring 234 to a position fully opening the valve plate 224, thereby allowing operation of the engine to continue at the mixture level supplied by the idle fuel system of the carburetor.

As the engine reaches idle speed, the valve plate 224 will suddenly open in the manner described above and, because of the heated combustible mixture created in the intake manifold 14 by gases flowing through the metering tube 110, will allow smooth engine operation to continue without any hesitation that might otherwise occur if the intake manifold were completely void of any fuel mixture at the time of opening of the value plate 224.

Although a power and deceleration governor system, according to the present invention, has been described particularly in relation to a single barrel carburetor, it is intended that the invention equally relate to carburetors having multiple primary bores and also those carburetors having primary and secondary bores. For example, in FIG. 10 there is depicted a power and deceleration governor valve housing 300 having primary bores 302 and 304 and also being provided with secondary bores 306 and 308 that correspond to primary and secondary bores of a carburetor. The secondary bores conduct fuel mixture only during high speed operation of the engine with which the carburetor is associated. As shown in FIG. 10, a rotary valve control shaft 310 may extend through an appropriate passage 312 of the valve housing 300 and may intersect both of the primary bores 302 and 304. Valve plates 314 and 316 may be immovably secured to the valve actuating shaft 310 in any desirable manner, thereby allowing the valves to be open and closed upon rotation of the shaft 310.

In FIG. 11 there is depicted a chart or graph representing a typical test that depicts total exhaust emissions of typical automotive engines. Total exhaust emissions are indicated in parts per million at various idling, accelerating, cruising and decelerating conditions of engine operation during a certain period of time. For example, the graph illustrated in FIG. 11 depicts engine operation for 137 seconds. Vehicle speed is depicted as a broad solid line 318 while total emissions of an automotive engine of a vehicle without an acceleration and deceleration governor is depicted as a thin solid line at 320. It will be observed that during the periods of engine deceleration, the total emission levels of the engine greatly exceed the maximum limit set forth on the chart. However, the same automotive engine, provided with an acceleration and deceleration governor, constructed according to the present invention, will produce an operating curve, such as that depicted in broken line at 322. It is quite obvious from a simple review of the comparison depicted in the chart set forth in FIG. 11 that total engine emissions will be substantially reduced through use of an acceleration and deceleration governor according to the present invention.

With respect now to FIG. 12, a similar graph or chart is shown, as compared to that illustrated in FIG. 11, depicting vehicle operation at test speeds of acceleration, cruise and deceleration over a period of 137 seconds, thereby producing a curve depicted by the broad solid line 324. The chart or graph depicts the carbon monoxide level of the exhaust emissions of a typical automotive engine by way of a thin solid curve 326. Carbon monoxide level of the same automotive engine equipped with a power and deceleration governor, according to the present invention, will produce carbon monoxide levels as shown by broken line curve 328. It is quite obvious that carbon monoxide will also be substantially reduced through utilization of a power and deceleration governor constructed in accordance with the present invention.

Similar reduction of oxides of nitrogen will also result through use of the power and deceleration governor concept of the present invention as depicted in FIG. 13. Again, the broad solid line curve represents engine acceleration, cruise and deceleration over a test period of 137 seconds. The thin solid line curve 332 represents oxides of nitrogen present in the exhaust emissions of a conventional internal combustion engine. The broken line curve, illustrated at 334, represents the levels of oxides of nitrogen present in the exhaust emissions during a similar test conducted on the same automotive engine operating under the same test conditions. It is also obvious that the presence of oxides of nitrogen in the exhaust emissions of automotive engines is substantially reduced through use of a power and deceleration governor constructed in accordance with the present invention.

FIG. 14 is a chart representing various engine operating characteristics during different phases of engine operation. For example, manifold pressure is depicted in inches of mercury during acceleration, cruise, idle and deceleration of the engine and compression pressure and cylinder power pressure are also depicted in pounds per square inch during these particular phases of engine operation. Additionally, the presence of oxides of nitrogen, hydrocarbons, carbon monoxide and air-fuel ratio are also depicted. As shown by the bracket at the left extreme portion of the chart, the power and deceleration governor system of the present invention effectively limits the vacuum depression to approximately 7.5 inches of mercury during full throttle, thereby maintaining acceleration at an optimum level and effectively eliminating many of the other undesirable effects that are caused by excessive acceleration. The power and deceleration governor system of the present invention completely restricts the flow of carbureted mixture into the manifold to approximately 17.5 inches of mercury and above. Maintaining the operating characteristics of the engine within the 7.5 to 17.5 manifold pressure range effectively accomplishes substantial improvements in fuel economy and exhaust emissions without adversely effecting engine operation to any noticeable degree. During rapid acceleration, the automotive engine may appear to be slightly sluggish although the rate of maximum acceleration will be quite acceptable. The driver of an automobile powered by the engine can very easily adjust his driving characteristics to the maximum rate of acceleration allowed by the acceleration governor portion of the system. The large amounts of hydrocarbon and carbon monoxide that are present in the exhaust emissions, when the engine is forced to operate under conditions where the manifold vacuum is above 17.5 inches of mercury are effectively eliminated and, therefore, hydrocarbon and carbon monoxide performance will remain quite low, as shown by those portions of the chart wherein the manifold pressure is between 7.5 and 17.5 inches of mercury. It becomes immediately apparent, as one reviews the center of the chart set forth in FIG. 14, that the most efficient part of the engine's vacuum range (7.5 inches to 17.5 inches of mercury) has remained unchanged by presence of the power and deceleration and governor system. The only effect on the automobile engine that is noticeable by the operator is the small apparent loss of power during full throttle acceleration.

The acceleration and deceleration governor of the present invention may readily be adjusted to reduce the high hydrocarbon build up during full throttle slow speed acceleration. It does this by controlling the intake manifold vacuum during this particular part of the operating cycle of the engine. The rich idle mixture that flows into the intake manifold and causes the hydrocarbon build up to reach 2000 parts per million during deceleration can be reduced to a negligible level during this particular part of the engine operation. Since increases in carbon monoxide present in the exhaust emissions are relative to hydrocarbon deposits, the presence of carbon monixide is also reduced to a negligible level through utilization of the acceleration and deceleration governor system of the present invention. Nitrogen oxides that are caused by high cylinder pressure and temperature can be predicted to be reduced, because, as the intake manifold vacuum is increased during acceleration, the cylinder pressure and temperature is also reduced, thereby reducing the oxides of nitrogen emitted from the exhaust system of the engine.

It is therefore apparent that the present invention is one well adapted to attain all of the objects and advantages that will become obvious and inherent from a description of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

Having thus fully described my invention I claim:

1. A deceleration cut-off and mixture flow controlling system for an automotive engine equipped with a carburetion system for injecting a combustible mixture of fuel and air into the intake manifold of the engine, said carburetion system incorporating housing defining a flow passage, said housing having located therein a primary fuel jet and an idle fuel jet for supplying fuel into a flow passage defined to be mixed with a quantity of air to provide a combustible mixture that may be introduced into the intake manifold of the engine and having a throttle valve disposed between the primary and idle fuel jets and being controllably movable by a throttle linkage, said system comprising:

a valve shaft extending through said housing and having a portion thereof rotatably positioned within said flow passage;

a fuel mixture cut-off and mixture flow controlling valve disposed in the flow passage of the carburetion system downstream of the idle fuel jet and being rotatably supported by said valve shaft, said valve being rotatably movable between open and closed positions;

valve actuator means being operatively connected to said valve and being capable of inducing rotary movement to said valve shaft and said valve element;

a conduit communicating intake manifold pressure of said engine to said valve actuator means and causing said valve actuator means to impart controlling movement to said valve element responsive to the pressure condition within said intake manifold; and means responsive to the position of the throttle linkage of the carburetion system for at least partially controlling application of intake manifold pressure to said valve actuator means and causing said valve element to be open during idle operation of said engine, to be fully closed during deceleration of said engine and to be in a partially open fuel mixture flow limiting condition when the intake manifold pressure of said engine is above a predetermined miximum level.

2. A deceleration cut-off and mixture flow controlling system as recited in claim 1, wherein said valve actuator means comprises:

a diaphragm type linear vacuum motor being disposed in generally fixed relation to said engine; and motion converting means interconnecting said valve shaft and said linear vacuum motor and imparting rotary movement to said valve shaft upon linear movement of said vacuum motor, said intake manifold pressure being controllably communicated to said vacuum motor responsive to said means responsive to the position of said throtte linkage.

3. A deceleration cut-off and mixture flow controlling system as recited in claim 2, wherein said system includes:

means for communicating atmospheric pressure to said vacuum motor during certain periods of engine operation to cause temporary deenergization of said vacuum motor.

4. A deceleration cut-off and mixture flow controlling system as recited in claim 3, wherein said means for communicating atmospheric pressure to said vacuum motor comprises:

valve means being connected to said means for communicating intake manifold pressure to said vacuum motor, said valve means being actuated responsive to opening and closing of said throttle valve and rendering said vacuum motor ineffective at certain positions of said throttle valve.

5. A deceleration cut-off and mixture flow controlling system as recited in claim 3, wherein:

a vacuum supply conduit is disposed in communication with the intake manifold of said engine and with said vacuum motor, thereby causing energization of said vacuum motor responsive to the pressure conditions present to said intake manifold during various phases of engine operation;

a vacuum cut-off valve being connected to said vacuum supply conduit and communicating atmospheric pressure into said vacuum supply conduit in the open position thereof; and means causing said vacuum cut-off valve to be moved to the open and closed positions thereof responsive to predetermined positions of said throttle valve of said carburetion system.

6. A deceleration cut-off and mixture flow controlling system as recited in claim 5, wherein said vacuum cut-off valve comprises:

valve body means being disposed in fixed relation to said intake manifold and having inlet and outlet passages formed therein, said inlet passage being communicated to the atmosphere and said outlet passage communicating with said vacuum supply conduit; and a movable valve element being disposed within said valve body and having flow passage means formed therein for registry with said inlet and outlet passages in the open position of said valve, said movable valve element being moved to the open and closed positions thereof responsive to said predetermined positions of said throttle valve.

7. A deceleration cut-off and mixture flow controlling system as recited in claim 1, including:

means urging said valve element toward a closed position thereof; and said vacuum motor developing a force opposing said urging means responsive to decrease in intake manifold pressure.

8. A deceleration cut-off and mixture flow controlling system as recited in claim 1, wherein:

said means communicating intake manifold pressure comprises a vacuum supply conduit extending from the intake manifold of said engine to said vacuum motor;

said valve actuator means includes a linear, diaphragm type vacuum motor; and said means at least partially controlling application of manifold pressure comprises a valve having an inlet communicated to the atmosphere and an outlet communicated to said vacuum supply conduit, said valve being controlled responsive to movement of the throttle linkage of said carburetor.

9. A deceleration cut-off and mixture flow controlling system as recited in claim 8, wherein said vacuum control valve comprises:

a valve body in which said inlet passages are formed, said valve body defining a valve chamber;

a valve element being movably disposed within said valve body and having passage means defined therein and registering with said inlet and outlet passages in the open position of said valve, said vacuum control valve communicating atmospheric pressure to said vacuum motor in the open position of said control valve.

10. A deceleration cut-off and mixture flow controlling system as recited in claim 9, wherein:

said vacuum control valve is closed at the idle position of said throttle linkage and is open at a throttle linkage position slightly opening said throttle valve.

11. A deceleration cut-off and mixture flow controlling system as recited in claim 1, wherein said valve actuator means comprises:

linear fluid motor means being disposed in fixed relation to said automotive engine and being controlled responsive to pressure conditions within the intake manifold of said engine; and means actuated by said linear fluid motor means and translating the linear movement of said motor means into rotary movement of said valve.

12. A deceleration cut-off and mixture flow controlling system as recited in claim 1, wherein said valve actuator means comprises:

a linear, diaphragm type vacuum motor being disposed in fixed relation to said automotive engine;

means communicating said vacuum motor with the intake manifold pressure of said engine and causing actuation of said vacuum motor responsive to variations in engine manifold pressure;

rack means being driven by said vacuum motor;

pinion gear means being fixed relative to said valve and imparting rotary movement to said valve responsive to linear movement of said rack means by said vacuum motor.

13. A deceleration cut-off and mixture flow controlling system as recited in claim 12, wherein said valve actuator means includes:

urging means being connected to said rack means and imparting a force to said rack means opposing the force imparted to said rack means by said vacuum motor and cooperating with said vacuum motor to position said valve responsive to the pressure within said intake manifold.

14. A deceleration cut-off and mixture flow controlling system as recited in claim 1, wherein said valve actuator means comprises:

a linear hydraulic motor being disposed in fixed relation to said engine;

means interconnecting said linear hydraulic motor with said valve and translating linear movement of said hydraulic motor into rotary movement of said valve;

hydraulic valve means being connected to said linear hydraulic motor and controlling actuation of said motor; and a linear diaghragm type vacuum motor being connected to said hydraulic valve means and being energized responsive to intake manifold pressure of said engine for imparting controlling movement to said hydraulic valve means.

15. A deceleration cut-off and mixture flow controlling system as recited in claim 14, wherein said valve actuator means includes:

means for deenergizing said vacuum motor responsive to the position of the throttle valve of said carburetor; and said urging means moving said valve toward a closed position thereof upon deenergization of said vacuum motor.

16. A deceleration cut-off and mixture flow controlling system as recited in claim 1, wherein said valve actuator means comprises:

continuously rotating drive motor means being disposed in generally fixed relation to said engine;

shaft means supporting said valve for rotation between open and closed positions for controlling the flow of fuel mixture into the intake manifold of said engine;

clutch means being connected between said drive motor means and said shaft means;

clutch actuator means being connected to said clutch means and being movable between positions causing said drive motor to impart frictional driving force to said shaft and a position releasing said drive motor from said shaft; and linear diaphragm type vacuum motor means being disposed in generally fixed relation to said engine and being operative, responsive to variations in intake manifold pressure of said engine, to impart controlling movement to said clutch actuator means.

17. A deceleration cut-off and mixture flow controlling system as recited in claim 16, including:

urging means being connected to said clutch means and imparting a force to said clutch means in a direction moving said valve to a closed position thereof, said urging means being overcome by said frictional driving force induced to said clutch means responsive to movement induced thereto by said clutch actuator means.

18. A deceleration cut-off and mixture flow controlling system as recited in claim 16, including:

means for deenergizing said vacuum motor responsive to the position of the throttle valve of said carburetor; and said urging means moving said valve toward a closed position thereof upon deenergization of said vacuum motor.

19. A deceleration cut-off and mixture flow controlling system as recited in claim 18, wherein said means for deenergizing said vacuum motor comprises:

a vacuum control valve housing having an inlet flow passage communicated with the atmosphere and an outlet flow passage communicated with said vacuum motor and defining a valve chamber intersected by said inlet and outlet flow passages;

a valve element being disposed within said valve chamber and being movable between an open position, allowing flow of atmospheric pressure through said vacuum control valve and into said vacuum motor, and closed positions blocking any flow of atmospheric pressure to said vacuum motor; and means imparting movement to said valve element responsive to the position of said throttle valve of said carburetor.

20. A deceleration cut-off and mixture flow controlling system as recited in claim 19, wherein said means imparting movement to said valve element comprises:

spring means carried by said vacuum control valve, said spring means urging said valve element toward a closed position thereof; and means secured to the throttle linkage of said carburetor and being disposed for engagement with said valve element, said means imparting controlling movement to said valve element responsive to movement of said throttle linkage.

21. A deceleration cut-off and mixture flow controlling system as recited in claim 1, including:

metering passage means communicating said intake manifold of said engine with the exhaust manifold of said engine and serving to meter exhaust gases from said exhaust manifold to said intake manifold during certain conditions of engine operation.

22. A deceleration cut-off and mixture flow controlling system for an automotive engine equipped with a carburetion system for injecting a combustible mixture of fuel and air into the intake manifold of the engine, said carburetion system incorporating a primary fuel jet and an idle fuel jet for supplying fuel into a flow passage defined to be mixed with a quantity of air to provide a combustible mixture that may be introduced into the intake manifold of the engine and having a throttle valve disposed between the primry and idle fuel jets, said throttle valve being controllably movable by a throttle linkage, said system comprising:

valve housing means interposed between said carburetor and said intake manifold and having a flow passage formed therein, said flow passage being in registry with flow passages formed in said carburetor and in said intake manifold;

a valve shaft extending through said housing and having a portion thereof rotatably positioned within said flow passage;

a valve element being disposed within said valve housing means being fixed to said valve shaft and being movable between open and closed positions for controlling the flow of fuel mixture from both said primary fuel jet and said idle fuel jet;

manifold pressure actuated valve actuator means being operatively connected to said valve and being responsive to manifold pressure to said engine for inducing controlling movement to said valve element;

vacuum supply passage means communicating intake manifold pressure with said valve actuator means; and vacuum control valve means being communicated with said vacuum supply passage means and being communicated with the atmosphere, said vacuum control valve means communicating atmospheric pressure to said valve actuator means and causing said valve element to be open during idle operation of said engine, to be fully closed during deceleration of said engine and to be in a partially open fuel mixture flow limiting condition when the intake manifold pressure of said engine is above a predetermined maximum level.

23. A deceleration cut-off and mixture flow controlling system as recited in claim 22, including:

metering passage means communicating the intake manifold of said engine with the exhaust manifold of said engine and metering exhaust gases from said exhaust manifold to said intake manifold during certain conditions of engine operation.

24. A deceleration cut-off and mixture flow controlling system as recited in claim 22, wherein said valve actuator means comprises:

a valve shaft disposed within said flow passage, said valve element being fixed to said valve shaft;

means for imparting rotary movement to said valve shaft; and a diaghragm type linear vacuum motor being disposed in generally fixed relation to said engine and being operatively connected to said means for imparting rotary movement to said valve shaft, said diaphragm manifold pressure being communicated to said vacuum motor.

25. A deceleration cut-off and mixture flow controlling system as recited in claim 22, wherein said vacuum control valve means comprises:

valve body means being disposed in fixed relation to said intake manifold and having inlet and outlet passages formed therein, said inlet passage being communicated to the atmosphere and said outlet passage communicating with said vacuum supply passage means; and a movable vacuum valve element being disposed within said valve body and having flow passage means formed therein for registry with said inlet and outlet passages in the open position of said valve, said movable vacuum valve element being moved to the open and closed positions thereof responsive to said predetermined positions of said throttle valve.

26. A deceleration cut-off and mixture flow controlling system as recited in claim 22, including means urging said valve element toward a closed position thereof; and said vacuum motor developing a force opposing said urging means responsive to decrease in intake manifold pressure.

27. A deceleration cut-off and mixture flow controlling system as recited in claim 22, wherein:

said vacuum control valve is closed at the idle position of said throttle linkage, is open at a throttle linkage position slightly opening said throttle valve and is closed during the remainder of movement of said throttle linkage toward the position fully opening said throttle valve.

* * * * *

UNITED STATES PATENT OFFICE

CERTIFICATE OF CORRECTION

Patent No. 3,948,231 Dated April 6, 1976

Inventor(s) Norris E. Smith

It is certified that error appears in the above-identified patent and that said Letters Patent are hereby corrected as shown below:

Column 2, line 36, "is" should read --it--
Column 6, line 13, "het" should read --jet--
Column 10, line 5, "presents" should read --prevents--
Column 13, line 64, "...is turn..." should read --is in turn--
Column 16, line 47, "communiction" should read --communication--
Column 17, line 21, "Fig. 1. surface" should read --Fig. 1.--; line 33 "surfacd" should read --surface--
Column 22, line 6, "...advantages that will..." should read --...advantages hereinabove set forth, together with other advantages that...--; line 59, "miximum" should read --maximum--
Column 26, line 32, "primry" should read --primary--
Column 27, line 13, "diaghragm" should read --diaphragm--; line 17, "diaphragm" should read --intake--

Signed and Sealed this

Twentieth Day of July 1976

[SEAL]

*Attest:*

RUTH C. MASON
*Attesting Officer*

C. MARSHALL DANN
*Commissioner of Patents and Trademarks*